United States Patent [19]

Eguchi et al.

[11] 4,393,794

[45] Jul. 19, 1983

[54] SEWING MACHINE WITH NEEDLE DROPPING HOLE CHANGING CONTROL DEVICE

[75] Inventors: Yasukata Eguchi, Kunitachi; Hideaki Takenoya; Yasuro Sano, both of Hachioji, all of Japan

[73] Assignee: Janome Sewing Machine Co. Ltd., Tokyo, Japan

[21] Appl. No.: 199,914

[22] Filed: Oct. 23, 1980

[30] Foreign Application Priority Data

Nov. 5, 1979 [JP] Japan ..... 54-152423[U]

[51] Int. Cl.[3] ..... D05B 1/14; D05B 3/02; D05B 75/00

[52] U.S. Cl. ..... 112/158 E; 112/168; 112/260

[58] Field of Search ..... 112/158 E, 168, 260

[56] References Cited

U.S. PATENT DOCUMENTS

| | | | |
|---|---|---|---|
| 3,358,631 | 12/1967 | Sharp | 112/260 |
| 3,552,337 | 1/1971 | Hanyu et al. | 112/168 X |
| 4,196,683 | 4/1980 | Eguchi | 112/158 E |
| 4,303,028 | 12/1981 | Takenoya et al. | 112/158 E |

FOREIGN PATENT DOCUMENTS

| | | | |
|---|---|---|---|
| 2924206 | 12/1979 | Fed. Rep. of Germany | 112/260 |

*Primary Examiner*—W. Carter Reynolds
*Attorney, Agent, or Firm*—Michael J. Striker

[57] ABSTRACT

A sewing machine has a stitch control pulse motor for changing the needle position and is connected to a needle plate by means of an intermediate control device which is operated by a starting device of the machine, to change the needle dropping hole.

1 Claim, 18 Drawing Figures

SEWING MACHINE WITH NEEDLE DROPPING HOLE CHANGING CONTROL DEVICE

BACKGROUND OF THE INVENTION

The invention relates to a sewing machine, and more particularly relates to a needle dropping hole changing control device of a sewing machine. The U.S. Pat. No. 4,303,028 discloses a needle dropping hole changing device, in which a pulse motor is employed for changing the needle position as well as the needle dropping hole from the laterally elongated one to the reduced circular one and vice versa, in dependence upon the stitching type such as the straight stitching or zigzag stitching which requires swinging movement of the needle. According to this prior art, the pulse motor changes the needle position and the needle dropping hole at the same time while the sewing machine is standstill. The pulse motor is, therefore, required to have a considerably powerful drive force. Accordingly the pulse motor is too large for the limited space of the machine housing. Moreover the increased inertia of the pulse motor produces an adverse influence to the swinging response of the needle.

It is therefore a general object of the present invention to eliminate such defects and disadvantages of the prior art. According to the invention, although the pulse motor changes the needle position in dependence upon the stitching type, it is required to function only for setting a control device which is operated by the starting drive of the sewing machine to change the needle dropping hole. The pulse motor is, therefore, not directly connected to the drive transmission linkage to the needle plate, but connected thereto through the intermediate control device, so that the load to the pulse motor may be remarkably reduced.

Thus it is a primary object of the invention to provide a control device between the stitch control pulse motor and the drive transmission linkage to the needle plate, so as to reduce the load applied to the pulse motor.

It is another object of the invention to operate the control device by the starting drive of the sewing machine to change the needle dropping hole in dependence upon the stitching type.

DESCRIPTION OF THE PREFERRED EMBODIMENTS

Figure 1:
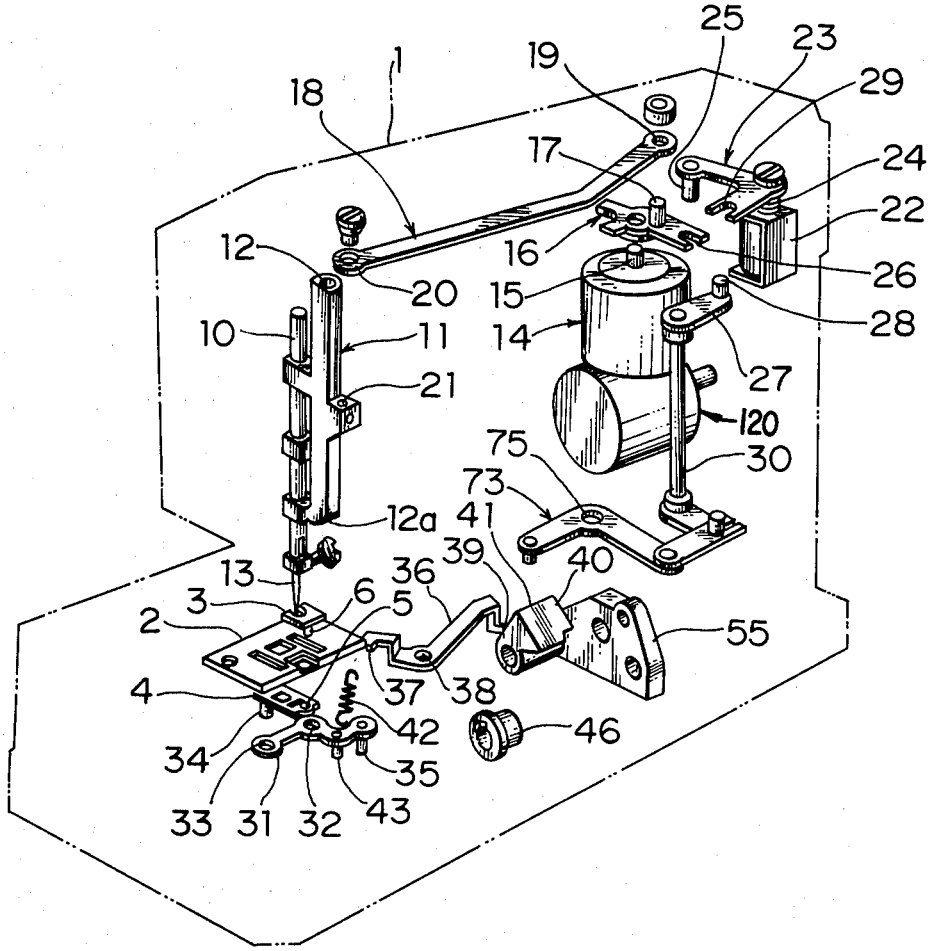
FIG. 1 is a perspective view of a main mechanism of the sewing machine, partially disassembled, showing an embodiment of the invention.
Figure 2:
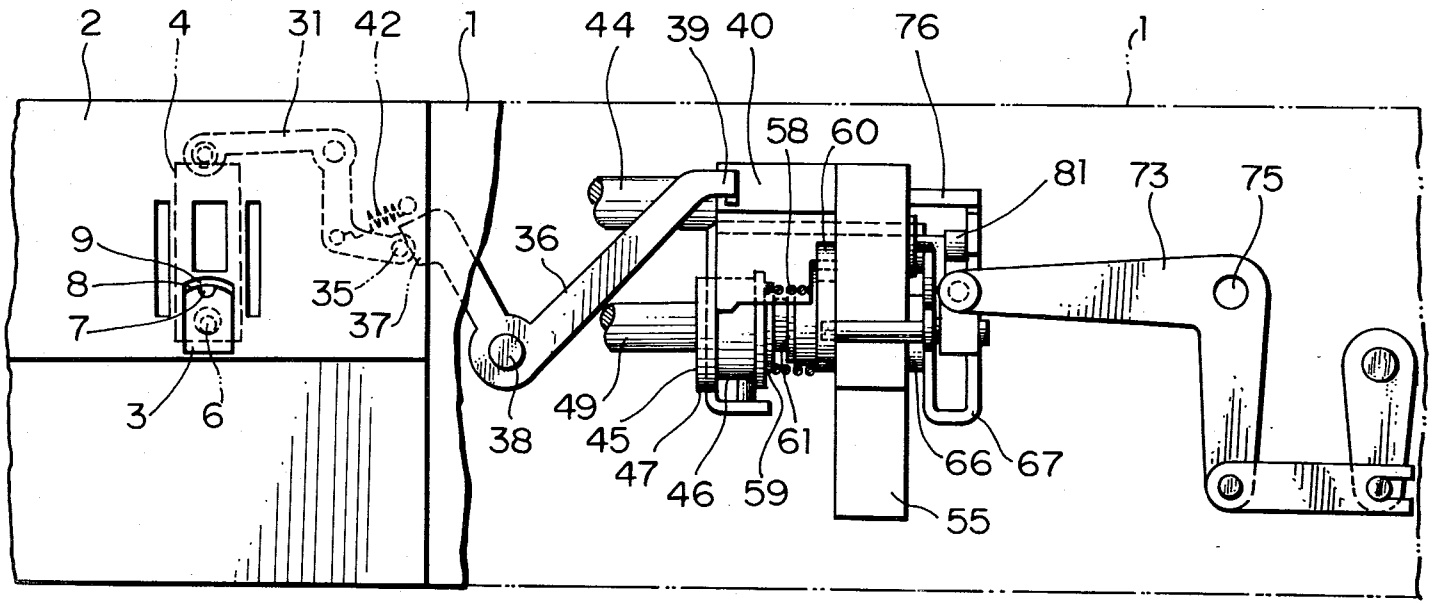
FIG. 2 is a plan view partially showing the the machanism of the invention.

In reference to FIGS. 1 and 2, the numeral 1 denotes a machine housing, 2 designates a needle plate, 3 denotes an auxiliary plate, and 4 designates an auxiliary plate actuating member. This member 4 is formed at its front part with a hole 5 into which a pin 6 provided on the auxiliary plate 3 is inserted, so that an edge part 8 with a small cutout 7 of the plate 3 does not cover a laterally elongated hole 9 formed of the needle plate 2 when the auxiliary plate actuating member 4 is displaced towards a machine operator. Thus, in such a case, the zigzag stitching with the lateral swinging movement of the needle is possible. If the member 4 is displaced in the direction away from the machine operator, the edge part 8 of the auxiliary plate 3 covers the laterally elongated hole 9 of the needle plate 2, and the reduced circular hole 7 is provided for the straight stitching. The numeral 10 is a needle bar with a needle 13 vertically reciprocated on a swingable support 11 which is pivoted at the up and down parts 12, **12*a* to the machine housing 1. Thus the needle bar 10 is swingingly moved around the pivots 12–12*a* within the laterally elongated needle hole 9**.

The numeral 14 is a needle swing control motor having a shaft 15 which is connected to a swingable arm 16 having a pin 17 connected to one end 19 of a transmission rod 18, the other end 20 of which is connected to a lateral projection 21 of the swingable needle bar support 11. If the pulse motor 14 rotates in the clockwise direction, the needle is moved to the right, and if the pulse motor 14 rotates in the opposite direction, the needle is moved to the left. The rotation phase of the pulse motor 14 determines the position of the needle. The numeral 22 is an electromagnetic solenoid having a plunger (not shown) which is connected to a clutch arm 23 which is biassed upwardly by a spring 24. If the solenoid 22 is energized, the arm 23 is pulled down against the action of the spring 24, so that a depending pin 25 may engage a cutout 26 formed in the swingable arm 16 at a later mentioned specific rotation phase of the pulse motor, and the arm 23 is disconnected from the arm 16 if the solenoid 22 is deenergized. The numeral 27 is a needle plate actuating lever having a pin 28 which is normally in engagement with a cutout 29 of the arm 23. The actuating lever 27 is influenced by rotation of the control motor 14 to move back and forth the auxiliary plate actuating member 4 via a rocking rod 30. The lever 27 is normally biased by a later mentioned spring to the counterclockwise direction. If the swingable arm 16 is not in engagement with the pin 25 of the clutch arm 23, the lever 27 is rotated at the maximum to the counterclockwise direction to provide the laterally elongated needle dropping hole 9 uncovered for the zigzag stitching. The position of the pin 25 under the influence of the spring biased actuating lever 27 coincides with the position of the cutout 26 where it has been brought about when the pulse motor 14 operates the swingable arm 16 to move the needle 13 to the maximum left.

Figure 3:
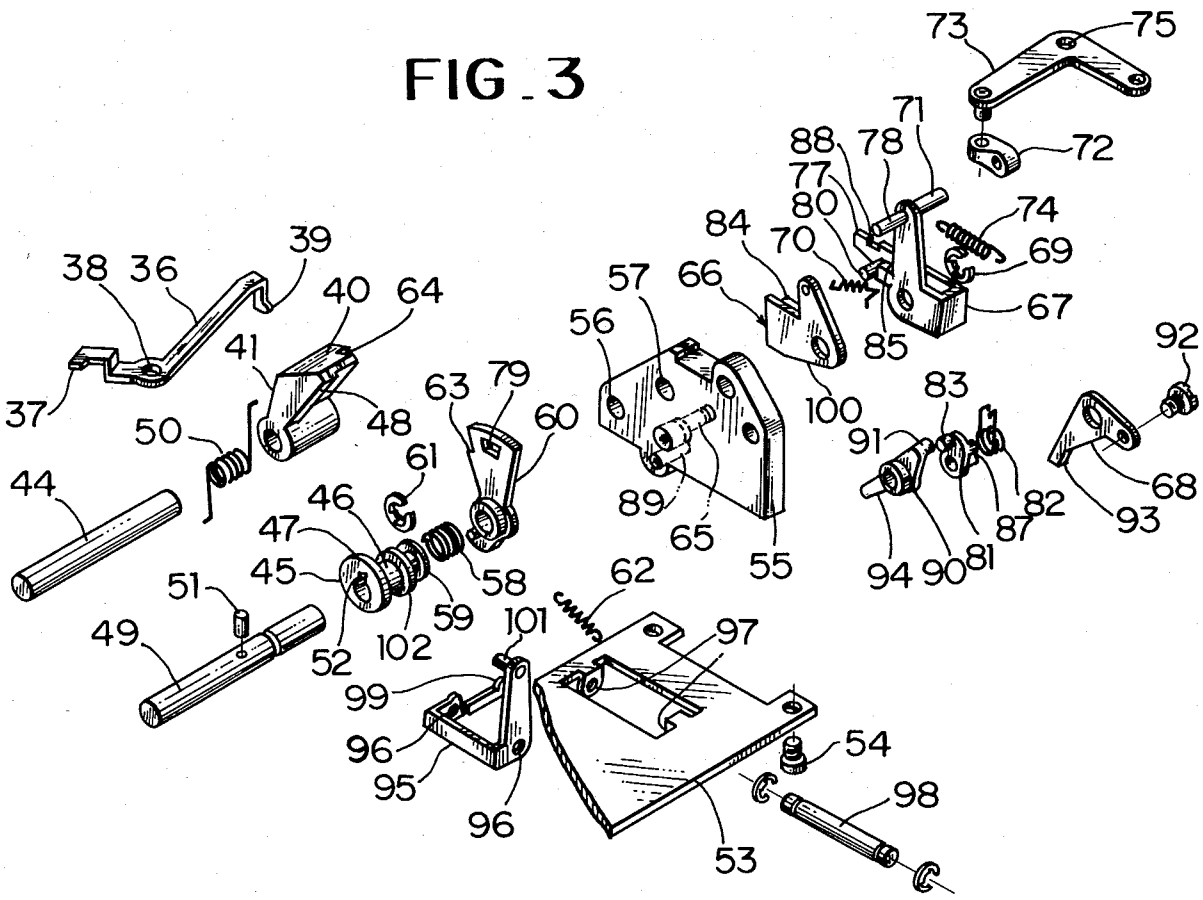
FIG. 3 is an exploded view of the embodiment of this invention.
Figure 7:
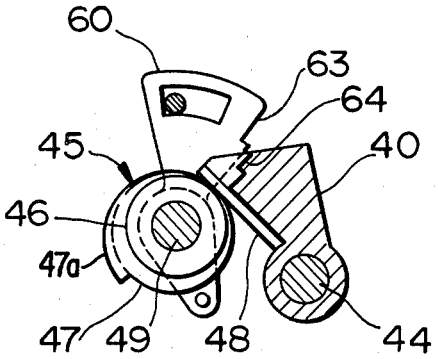
FIGS. 7 to 12 are partial views showing the operation of the invention.

The numeral 31 is an auxiliary plate actuating lever which is pivoted to the machine housing 1 via a center hole 32. The lever 31 has another hole 33 formed at one end thereof which is inserted with a pin 34 of the auxiliary plate actuating member 4. The lever 31 has a pin 35 provided at the other end thereof which is, as shown in FIG. 2, in engagement with an end 37 of a follow lever 36. The follow lever 36 is pivoted to the machine housing 1 at a center hole 38, and its other end 39 adapts to follow a rear portion 41 of an auxiliary plate actuating arm 40. A spring 42 is at one end fixed to the machine housing 1 and at the other end connected to a pin 43 of the lever 31, so that the spring 42 biases the lever 31 to the counterclockwise direction in FIG. 2, thereby to normally bias the auxiliary plate 3 away from the laterally elongated hole 9 of the needle plate 2. As shown in FIG. 3, the arm 40 is turnably mounted on a horizontal feed shaft 44 fixed to the machine housing 1, but is prevented from axial displacement. The arm 40 has a follower face 48 to engage a first cam 46 or a second cam 47 of cam member 45 which is secured to a feed cam shaft 49 which is rotated in the counterclockwise direction, in relationship of 1:1 with an upper shaft (not shown) of the sewing machine. The cam member 45 which is shown in detail in FIG. 7, is movable in the axial direction. A spring 50 is provided to normally bias the arm 40 toward the cam member 45. A guide pin 51 on the feed cam shaft 49 engages an axial groove 52 of the cam member 45. Thus the cam member 45 is rotated with the feed cam shaft 49 and is displaced axially of the shaft 49. A feed bed plate 53 is secured to the machine housing 1 and fixedly holds a bracket 55 by a pair of screws 54.

Figure 4:
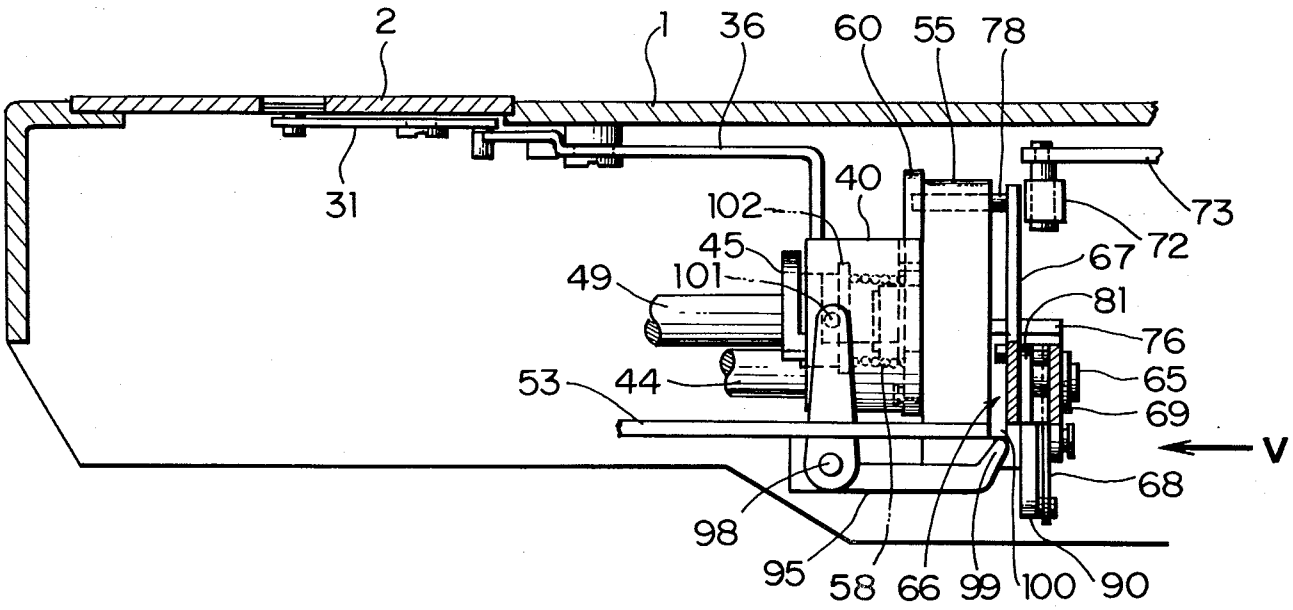
FIG. 4 is a front elevational view showing a part of the invention.
Figure 5:
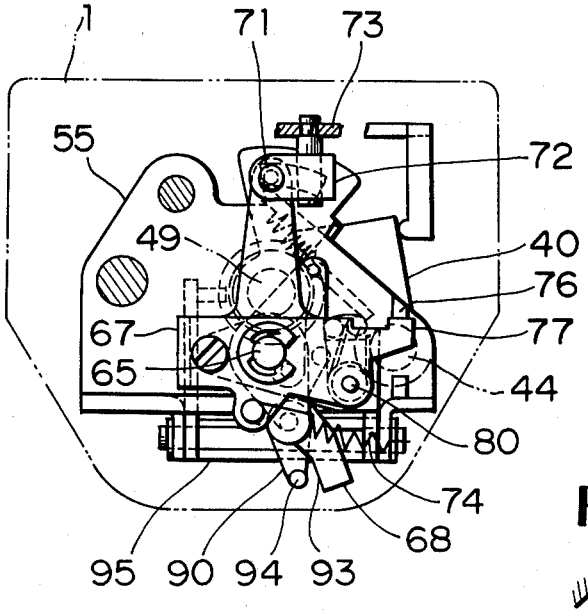
FIG. 5 is a side view taken in the direction of arrow V in FIG. 4.

The bracket 55 has a hole 56 through which the horizontal feed shaft 44 extends and a hole 57 through which the feed cam shaft 49 extends (see FIG. 3). The cam shaft 49 is provided with a spring 58, via a washer 59, which biases the cam member 45 in the leftward direction in FIG. 3. The cam shaft 49 also turnably holds a pawl 60 which is prevented from axial displacement by an E typed ring 61, and the pawl is normally pressed agains the bracket 55 by the spring 58 as shown in FIG. 2. The axial groove 52 of the cam member 45 is so formed as to limit the leftward axial displacement of the cam member 45. The pawl 60 is normally biased in the counterclockwise direction in FIG. 3 by a spring 62, so that a cutout 63 of the pawl 60 may engage a cutout 64 of the arm 40 as will be mentioned later. An actuating cam 66, an actuating arm 67 and a releasing arm 68 are turnably mounted on a shaft 65 of the bracket 55 on the opposite side thereof, and are prevented from axial displacement by an E-ring 69 as shown in FIGS. 3 and 4. The actuating cam 66 is normally biased in the clockwise direction in FIG. 3 by a spring 70. A pin 71 of the actuating arm 67 is connected to one arm of a bellcrank lever 73 via a connecting element 72. The actuating arm 67 is normally biased in the clockwise direction in FIG. 3. The actuating link 73 is pivoted at the intermediate part 75 to the machine housing 1 and is biased to the counterclockwise direction in FIG. 1 by a spring (not shown) to turn the clutch arm 23 in the clockwise direction. In the condition as shown in FIG. 5 where an end portion 77 of the actuating arm 67 contacts the stopper 76 provided on the bracket 55, the position of the pin 25 of the arm 23 coincides with the position of the cutout 26 the swingable arm 16 which has been displaced when the pulse motor is operated to displace the needle 13 to the maximum leftward point.

Figure 6:
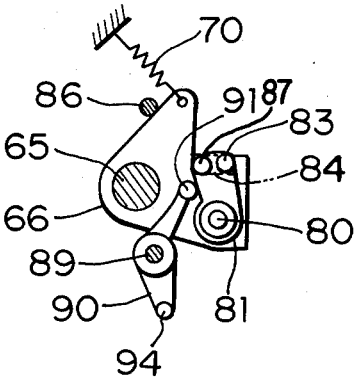
FIG. 6 is a partial view of a changing mechanism of the invention.

A pin 78 which is coaxial with the pin 71 of the actuating arm 67 extends through an opening 79 of the pawl 60. The actuating arm 67 has another lower pin 80 on which a pawl 81 is turnably mounted and normally biased in the clockwise direction by a spring 82 in FIG. 3, so that a pin 83 of the pawl 81 may be pressed against a cam face 84 of the actuating cam 66. The actuating arm 67 has a stopper part 85 for the pin 83 of the pawl 81. The bracket 55 is provided with a stopper pin 86 which is pressed against by the actuating cam 66 as shown in FIG. 6. In this condition, and when the end 77 of the arm 67 is pressed against the stopper 76 of the bracket 55 as shown in FIG. 5, a little clearance is provided between the pin 83 and the cam face 84. The spring 82 is mounted on the axial boss of the pawl 81 and is at one end anchored to the recess 88 of the arm 67 and is at the other end pressed against the projection 87 of the pawl 81. A release pawl 90 is turnably mounted on a pin 89 of the bracket 55. The release pawl 90 has one end 91 which may contact the actuating pawl 81 as shown in FIG. 6. The releasing arm 68 is fixed to the actuating arm 67 by a screw 92 so that the end 93 may contact the other end 94 of the pawl 90 as shown in FIG. 5. An actuating cam link 95 is pivoted on the bed plate 53 by means of a shaft 98 extended through two opposite holes 96 of the link 95 and two opposite holes 97 of the feed bed plate 53. The cam link has one end 99 contacting a bottom 100 of the cam 66, and pin 101 provided at the upper end thereof and contacting the inner side of a flange 102 of the actuating cam 45 as shown in FIG 4.

A reference will be made to operation of the above mentioned structure. FIGS. 2, 4, 5 and 6 show a condition in which the auxiliary plate 3 is, as shown in FIG. 2, moved toward the sewing operator and the elongated needle dropping hole 9 is made effective ready for zigzag stitches with the needle swinging movement. That is, the solenoid 22 is non-energized and the clutch arm 23 is released from the swingable arm 16, so that the end part 77 of the actuating arm 67 may be pressed against the stopper 76 of the bracket 55 by means of a spring 74 as shown in FIG. 5. The actuating cam 66 is pressed against the stopper 86 by the spring 70 with a space between the cam face 84 and the actuating pin 83 of the actuating pawl 81 as shown in FIG. 6. One end 99 of the actuating cam link 95 engages the lower surface 100 of the actuating cam 66, and the upper pin 101 of the link 95 is located on the left side of the flange 102 of the actuating cam 45 as shown in FIG. 4, and the auxiliary plate actuating cam 45 is displaced to the maximum leftward position by the spring 58.

As seen from FIG. 7, the cam member 45 is constituted by three cam faces 46, 47*a* and 47 arranged side by side. The cam faces 46 and 47 have circular cross section, whereas cam face 47*a* is in the form of a circular section arranged between the cam faces 46 and 47. The radius of cam face 47 is larger than that of cam face 46, and the radius of cam segment 47*a* is larger than the radius of cam face 47. The cam face 46 is mounted concentrically on the cam shaft 49, whereas the cam faces 47*a* and 47 are eccentric.

FIG. 7 shows a condition in which the follower face 48 of the auxiliary plate autuating arm 40, at this time, engages the first cam face 46 of the auxiliary plate actuating cam member 45. In order to maintain a predetermined angular position of the auxiliarly plate actuating arm 40 irrespectively of the rotation of the sewing machine, cam faces 47*a* and 47 are eccentrically mounted on shaft 49 in such a manner that at a point the circumference of cam face 46 slightly exceeds the circumference of the two cam faces 47*a* and 47. This angular position of the arm 40 causes the lever 36 to turn in the clockwise direction in FIGS. 1 and 2. As the result, the auxiliary plate 3 is displaced toward the machine operator to provide the laterally elongated needle dropping hole 9 for zigzag stitches due to the action of tension spring 42. In this condition, since the pulse motor 14 is not connected to the clutch arm 23, it can exclusively control the lateral swinging movement of the needle 13 via the transmission rod 18.

If the straight stitching is selected, the motor 14 starts to change the needle dropping hole from the elongated one to the reduced one at a predetermined rotation phase of the sewing machine when the needle 13 is located above the needle plate 2, and the needle dropping hole is switched to the reduced circular hole while the sewing machine is rotated. That is, the straight stitching is selected under the condition as shown in FIG. 7 in which the auxiliary plate acutating arm 40 engages the cam face 46 where the cam face 46 is slightly higher than the minimum cam lift of the second cam face 47 of the auxiliary plate actuating cam 45. When the sewing machine reaches this rotation phase again after this selection, the control pulse motor 14 is operated by an electronic control device (not shown) to displace the needle 13 to the maximum leftward position through the swingable arm 16 and the transmission rod 18. Then the swingable arm 16 is turned in the counterclockwise direction in FIG. 1 where the cutout 26 of the swingable arm 16 coincides with the pin 25 of the clutch arm 23. Simultaneously the solenoid 22 is energized to connect the clutch arm 23 to the swingable arm 16. The electronic control device timingly confirms this engagement and operates the pulse motor 14 to move the needle 13 to a center of the lateral swinging region thereof. Accordingly, the needle plate actuating ballcrank lever 73 is turned around a pivot 75 in the clockwise direction in FIGS. 1 and 2.

Figure 8:
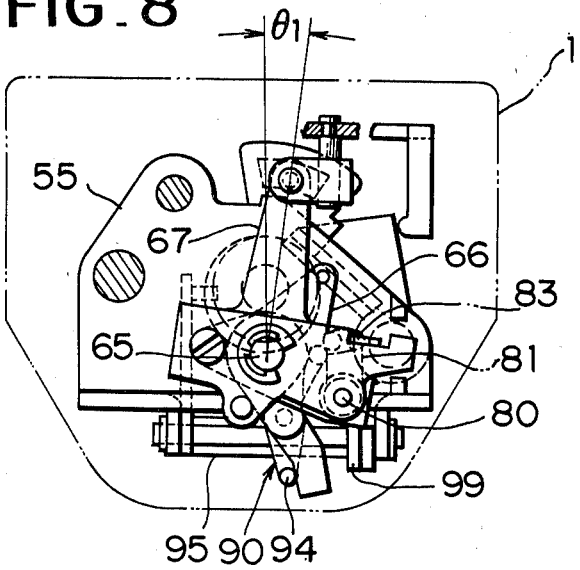
Figure 9:
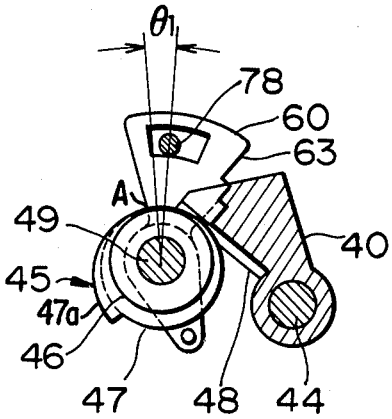
Figure 10:
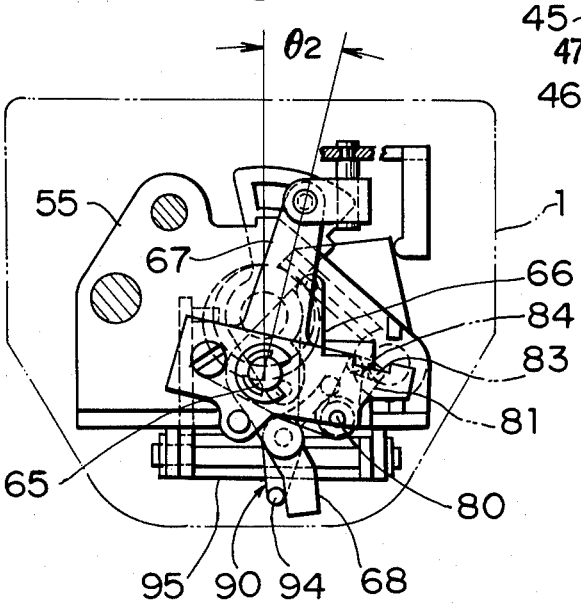

FIG. 8 shows the turning process of the ballcrank lever 73. Namely due to the clockwise turning movement of the ballcrank lever 73, the actuating arm 67, via the connecting element 72, is turned on the shaft 65 a distance $\theta_1$ in the clockwise direction as shown in FIG. 8 from the state in FIG. 5 where the fixed shaft 65 and the pin 71 are on a perpendicular line. Then the actuating pin 83 of the pawl 81 pivoted on the pin 80 of the arm turns the cam 66 against the spring 70 in the clockwise direction in FIG. 8 (see FIG. 6). The bottom 100 of the cam 66, therefore, turns the link 95 in the clockwise direction. As the result, the upper pin 101 of the link 95 displaces the cam member 45 in the rightward direction in FIG. 4 against the action the spring 58, and the follower face 48 of the actuating arm 40 engages the second cam face 47. Then, in reference to FIG. 9, the pawl 60 biased by the spring 62 in the clockwise direction contacts the auxiliary plate actuating arm 40. When the actuating arm 67 is turned a distance $\theta 2$ as shown in FIG. 10, the releasing arm 68 fixed to the arm 67 turns the releasing pawl 90 in the clockwise direction to release the pin 83 of the actuating pawl 81 from the cam face 84 of the actuating cam 66. The cam 66 is, therefore, returned by the spring 70 to the stopper 86 in FIG. 6. However since the cam face 46 is higher than the instant cam face 47 to which the follower face 48 of the arm 40 is kept engaged as shown in FIG. 9, the cam member 45 is not displaced in the leftward direction by the spring 58 in reference to FIG. 4.

Figure 11:
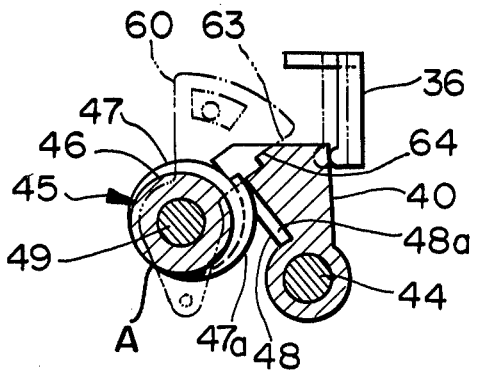
Figure 12:
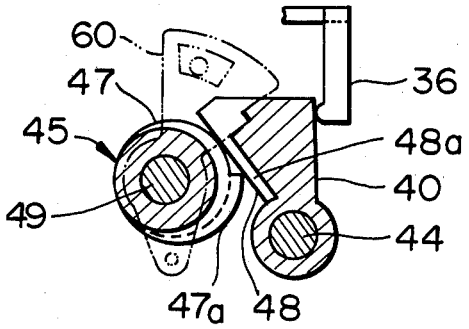

When the sewing machine is rotated by a separately installed machine motor 120 (FIG. 1) which constitutes the starting drive of the machine, and the feed cam shaft 49 rotates about 180° in the clockwise direction as shown in FIG. 11, the auxiliary plate actuating arm 40 is turned in the clockwise direction by the second cam face 47 and turns the pawl 60 to the clockwise direction, so that the cutouts 63 and 64 contact each other and they are locked. The cam section 47*a* engages during the rotation of shaft 49 one side 48*a* of the follower part 48 of the arm 40 to prevent the axial movement of the cam member 45 until the arm 40 is locked by the pawl 60. The condition of the actuating arm 40 in FIG. 11 shows that the auxiliary plate 3 is moved in the direction away from the machine operator in FIG. 2 and covers the elongated hole 9 to provide a reduced circular hole 7 for the straight stitching. As the sewing machine further rotates, the section 47*a* of the actuating cam 45 disengages, as shown in FIG. 12, from the side 48*a* of the arm 40, and the cam member 45 is returned by the spring 58 to the initial position axially of the cam shaft 46 as shown in FIGS. 2 and 4. Thus the arm 40 is locked by the pawl 60 for the straight stitching as shown in FIG. 12.

When the zigzag stitching is selected from the above mentioned locking condition, the solenoid 22 is deenergized and releases the swingable arm 16 from the clutch arm 23. As the result, the actuating arm 67 and the releasing arm 68 are returned to the condition as shown in FIG. 5. Therefore, pin 78 releases the pawl 60 which in turn releases the auxiliary plate actuating arm 40 from the locked condition. Thus, the auxilary plate 3 is moved toward the machine operator and the elongated hole 9 is provided for the zigzag stitching.

Figure 13:
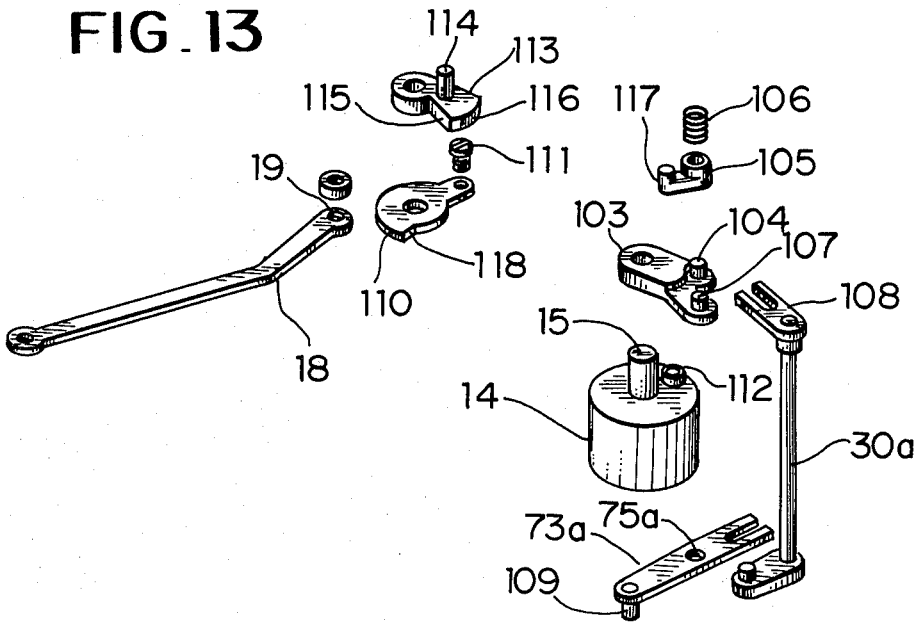
FIG. 13 is an exploded view of another embodiment of the invention.

A next reference will be made to an embodiment which is operated to change the needle dropping hole without using the electromagnetic solenoid. FIG. 13 shows a disassembling view of main parts different from those in FIGS. 1 and 3. A shaft 15 of the control motor 14 is pivoted with a needle plate control arm 103, and pin 104 provided on the arm 103 is pivoted with an actuating pawl 105 which is biased by a spring 106 to the clockwise direction. The arm 103 is provided with a pin 107 at its end onto which a fork 108 fixed to a needle plate actuating rod 30*a* is normally mounted. The rod 30*a* actuates a needle plate actuating lever 73*a* which is pivoted to the machine body 1 through a shaft hole 75*a*.

A pin 109 moves the connecting pivot block 72. The arm 103 is biased by the spring 74 to the counterclockwise direction, and this rotation of the arm 103 brings about rotation of the arm 67 such as $\theta 1$ or $\theta 2$ in FIGS. 8 or 10. The shaft 15 of the motor 14 is also pivoted with a releasing plate 110 which is secured by a screw 111 to a boss 112 of the motor 14. The shaft 15 is further fixed with an amplitude actuating arm 113, and a pin 114 of the arm 113 is pivoted with one end 19 of the amplitude rod 18. Sides 115 and 116 of the arm 113 engage a pin 117 of the pawl 105. When the pin 117 releases from the side 115 to the side 116, it engages a cam face 118 of the releasing plate 110.

Figure 14:
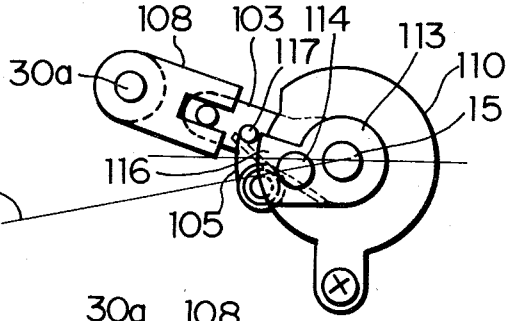
FIGS. 14 to 18 are partial views showing the operation of the other embodiment.
Figure 15:
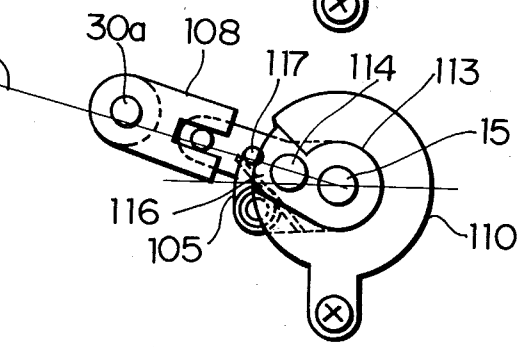

FIGS. 14 to 18 are for explaining each of actions of the parts in FIG. 13. FIGS. 14 and 15 are for enabling the zigzag stitching, and show respectively the maximum left and right lateral amplitude positions therefor. The pin 114 of the amplitude actuating arm 113 is different in the respective views, and the pin 117 of the pawl 105 engages an end 116 of the amplitude actuating arm 113. (L) and (R) indicate obliquity of the pin 114 when it is positioned to the maximum position.

Figure 16:
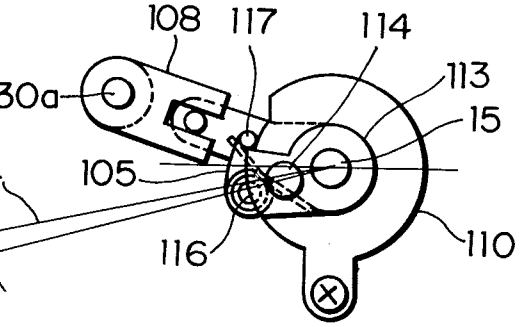
Figure 17:
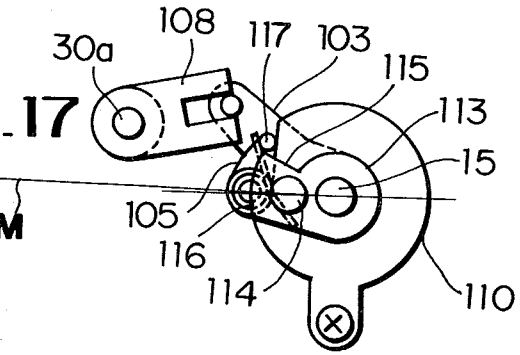

When the straight stitching is selected, the control motor 15 is driven by the separately installed electronic control device at the above mentioned specific rotation phase in relation with the rotation phase of the auxiliary plate actuating cam 45 in FIG. 7, and when the motor 15 rotates, as shown in FIG. 16, and amplitude actuating arm 113 at a slight angle than the state in FIG. 14 in the counterclockwise direction, the pin 117 of the actuating pawl 105 drops at the side 115 of the arm 113. Subsequently, the control motor 14 moves the pin 114 of the arm 113 to a position (M) corresponding to the center of the needle lateral amplitude as shown in FIG. 17. Since the actuating arm 113 is engaged at its side with a pin 117 of the pawl 105, the arm 113 rotates to the clockwise direction as shown, and accordingly the arm 103 rotates to rotate a needle plate actuating rod 30*a* to the counterclockwise direction. This rotation makes rotation of an angle $\theta 2$ of the actuating arm 67 in FIG. 10.

The auxiliary plate 3 covers the elongated hole 9 together with the rotation of the sewing machine as explained above on the embodiment using the solenoid, and makes the circular hole for the straight stitching with the circular hole 7.

Figure 18:
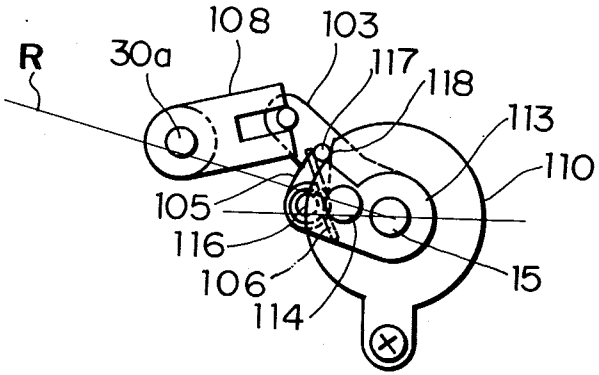

When the zigzag stitching is selected from the above condition, the control motor 14 moves, as shown in FIG. 18, the amplitude actuating arm 113 to the maximum rightward (R). The pin 117 of the pawl 105 is rotated to the counterclockwise direction against the spring 106 by the cam face 118 of the releasing plate 110, and moves to the side 116 from the side 115 of the amplitude actuating arm 113. The needle plate control arm 103 is released from the amplitude actuating arm 113 to the condition in FIG. 12. The elongaged hole 9 is made operative ready for the zigzag stitching.

What is claimed as new and desired to be protected by Letters Patent is set forth in the appended claim:

1. A sewing machine having a pulse motor operatively connected to a needle of the sewing machine to control the needle position and selectively operated to change the position of the needle and exchange a laterally elongated needle dropping hole for a reduced circular dropping hole and vice versa in dependence upon the stitching type, said needle plate being provided with an auxiliary needle plate which is formed with the reduced circular needle dropping hole and is selectively displaced by a transmission linkage to a position in which the auxiliary needle plate covers the laterally elongated needle dropping hole of the needle plate to provide the reduced circular needle dropping hole and to a position in which the auxiliary needle plate is spaced from the laterally elongated needle dropping hole of the needle plate, comprising operating means movable between a first and second predetermined positions, clutch means normally connected to the operating means and selectively operated to connect the pulse motor to the operating means when the pulse motor is driven to a predetermined angular position displacing the needle to a predetermined position, control means operatively connected to the operating means and to the transmission means, said control means including a cam member displaced to a predetermined position by a drive force of the pulse motor through the operating means, a follower member engaging the cam member, said cam member being rotated by a starting drive of the sewing machine to displace the follower member to a predetermined set position, thereby to displace the auxiliary needle plate relative to the needle plate through the transmission means, and means for holding the follower member in the set position.

* * * * *